United States Patent [19]

King

[11] Patent Number: 4,901,852

[45] Date of Patent: Feb. 20, 1990

[54] PROTECTIVE COVER FOR A PAGER

[75] Inventor: Jeffrey S. King, Boynton Beach, Fla.

[73] Assignee: Motorola, Inc., Schaumburg, Ill.

[21] Appl. No.: 341,877

[22] Filed: Apr. 24, 1989

[51] Int. Cl.[4] ..... B65D 85/38; B65D 65/02

[52] U.S. Cl. ..... 206/320; 206/497; 224/240

[58] Field of Search ..... 206/320, 497, 316.2; 224/246, 240, 236

[56] References Cited

U.S. PATENT DOCUMENTS 1,535,312 4/1925 Hosking ..... 206/316.2
4,006,764 2/1977 Yamamoto et al. ..... 206/320
4,420,078 12/1983 Belt et al. ..... 224/236
4,479,596 10/1984 Swanson ..... 224/240 X

*Primary Examiner*—William Price
*Attorney, Agent, or Firm*—Vincent B. Ingrassia; Anthony J. Sarli, Jr.

[57] ABSTRACT

A protective cover for pagers comprises a film of transparent stretchable plastic (e.g. 595HC silicon plastic) formed to cover the top, four sides, and at least a portion of the bottom of a pager. The cover includes accordion type pleats which are positioned to reside adjacent switches, a belt clip, and the like, to allow operation thereof.

9 Claims, 2 Drawing Sheets

PROTECTIVE COVER FOR A PAGER

The present invention pertains to a protective cover for pagers, portable radios, and the like and more particularly to a cover which protects the device against shock, as well as damage from moisture and chemical intrusion.

BACKGROUND OF THE INVENTION

Pagers and small portable radios which are carried virtually continuously are subject to many hazards that endanger the continuous and reliable use thereof. Many people that use pagers and small portable radios have jobs that require them to be outside in all types of weather, for example policemen and deliverymen, and, because the pagers and portable radios are constantly carried and used many times each day, they are subject to being dropped, bumped, etc. While the housings of these devices provide some protection against normal use, the protection is minimal against rain, high humidity environments, chemical fumes, shock, vibration and the like. Shock, vibration, water and chemical damage account for approximately 75% of the failures in pagers, small portable radios, and the like.

The major attempts to cure this problem have been limited to including material inside the case, e.g. foam rubber, to absorb shock and to making the housing water proof. The problems with these solutions are that the foam rubber can turn hard and useless without the operator noticing, since it is internal, and the moisture proof seal of the housing can be ruptured by shock or vibration without the operator being aware of the rupture. Some attempts have been made at providing a cover but these covers generally do not protect against all of the potential hazards, including moisture and shock.

SUMMARY OF THE INVENTION

It is an object of the present invention to provide a new and improved protective cover for pagers, portable ratios, and the like.

It is another object of the present invention to provide a new and improved protective cover for pagers, portable radios, and the like which is capable of protecting the device against most daily hazards, such as rain, high moisture and chemical atmospheres, shock, vibration, etc.

It is a further object of the present invention to provide a new and improved protective cover for pagers, portable radios, and the like which is easy and inexpensive to manufacture and which can be easily used.

These and other objects are realized in a protective cover for pagers, portable radios, and the like including a film of transparent, stretchable plastic formed to cover major openings and at least partially surround and tightly adhere to the surfaces of the pager, portable radio, and the like. In a further embodiment the film is formed with thicker portions positioned adjacent to edges and corners of the pager, portable radio, and the like to reduce shock and vibration due to dropping, bumping, etc.

BRIEF DESCRIPTION OF THE DRAWINGS

Referring to the drawings, wherein like characters indicate like parts throughout.

DESCRIPTION OF THE PREFERRED EMBODIMENT

Figure 1:
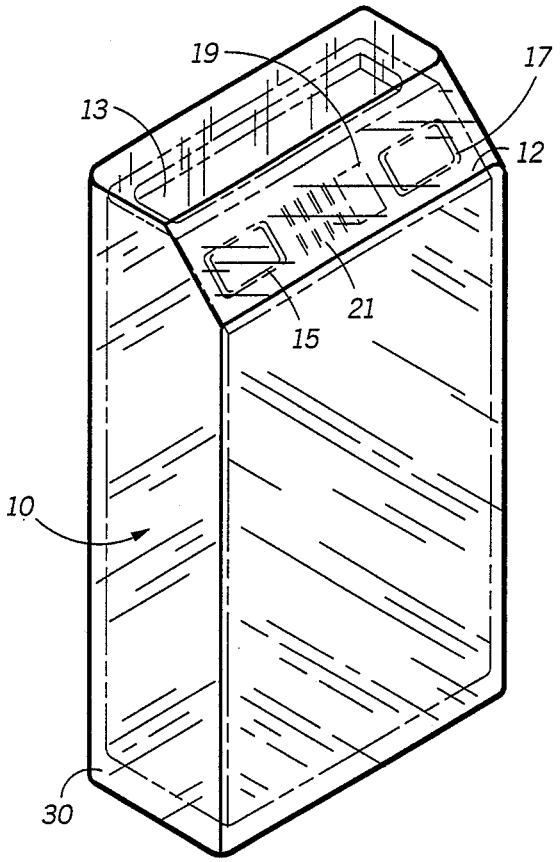
FIG. 1 is a view in perspective of a protective cover embodying the present invention and having a pager positioned therein.
Figure 4:
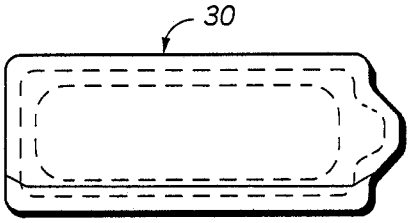
FIG. 4 is a view in top plan of the protective cover illustrated in FIG. 2.
Figure 2:
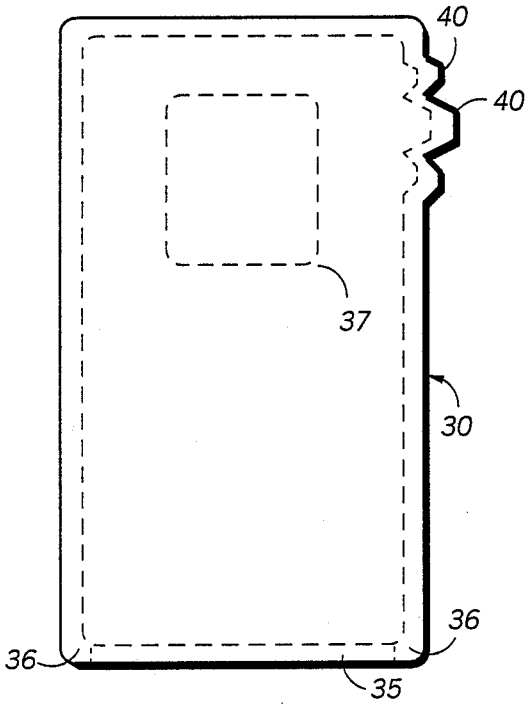
FIG. 2 is a view in front elevation of the protective cover illustrated in FIG. 1.
Figure 3:
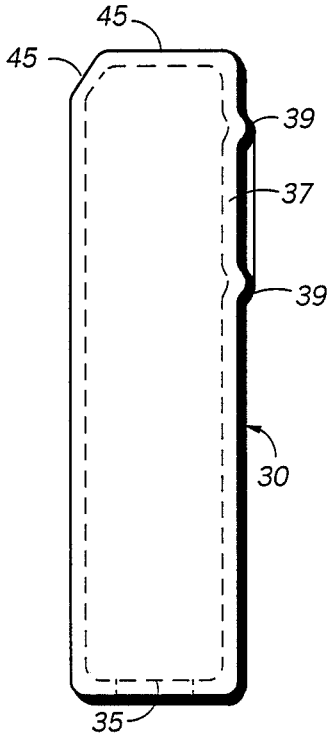
FIG. 3 is a sectional view of the protective cover as seen from the line 3—3 in FIG. 2.
Figure 5:
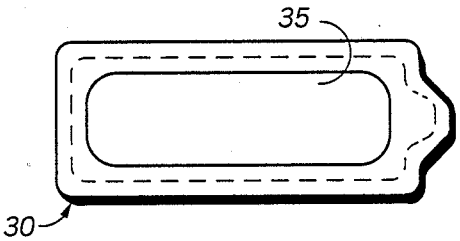
FIG. 5 is a view in bottom plan of the protective cover illustrated in FIG. 2.

Referring specifically to FIG. 1, a pager 10 is illustrated having a top 12, which includes a generally perpendicular portion with a display 13 therein and an inclined portion with two push buttons 15 and 17, a light 19 and a speaker etc. 21 therein. Pager 10 further includes four sides and a bottom. The back side of pager 10 may include a removable belt clip (not shown) and one side has a sliding contact, power switch (not shown) mounted therein. Pager 10 is used as an example in this explanation because of its complexity and various types of communication (sound, visual, etc.) with the operator and it should be understood that protective covers embodying the present invention can be used with many types and shapes of pagers, small portable radios, and the like.

A protective cover 30 embodying the present invention is illustrated in FIG. 1 substantially surrounding pager 10. Additional views illustrating more detail of cover 30 are presented in FIG. 2–5. Cover 30 is constructed from a film of transparent, stretchable plastic and is formed somewhat smaller than pager 10 so as to surround and adhere to the surfaces of pager 10. In this embodiment cover 30 is formed of a high strength silicon, sold as 595HC type by Dow Corning Inc. This material is a clear plastic which will stretch up to 300% and is tear resistant. The protective cover may be constructed in a variety of different ways but injection and compression molding are believed to be the preferred methods, with injection molding possibly being the least expensive.

Protective cover 30 is formed with an opening 35 in the bottom for insertion of pager 10 therein. Opening 35 is formed so that protective cover 30 extends inwardly beyond the edges of pager 10 and thereby prevents moisture from entering protective cover 30 by capillary action and the like. Also, protective cover 30 includes a thicker portion 36 adjacent opening 35 and adjacent the lower edges of pager 10. In general, protective cover 30 is approximately 0.030 inches thick with thicker portion 36 being approximately 0.100 inches thick. Thicker portion 36 acts to pad the lower edges of pager 10 so that if pager 10 is dropped, shock to pager 10 is substantially reduced. It will of course be understood that protective cover 30 may be constructed so that all edges and corners are thicker, but it is believed that pager 10 is most likely to be dropped so that the bottom hits first and, therefore, the present embodiment is believed to be the most practical. Further, all of protective cover 30 provides some padding to reduce shock and vibration in the event pager 10 is dropped or bumped and thicker portions are only used as additional protection in areas likely to receive the hardest hits. Also, thicker portion 36 increases the toughness of protective cover 30 and substantially increases resistance to tearing during insertion of pager 10 into protective cover 30.

Protective cover 30 further has an opening 37 in the back side thereof for a belt clip to operatively protrude therethrough. This, of course is optional, and other pagers, portable radios, and the like may have different devices for attaching them to the operator, or differently positioned belt clips. An accordion type pleat 39 is formed in the film of plastic material surrounding opening 37 to increase the tightness of protective cover 30 adjacent to the belt clip and, thereby, reduce the possibility of moisture, etc. from entering protective cover 30.

An accordion type pleat 40 is formed in the side of protective cover 30 so as to surround and overly the sliding contact, power switch of pager 10. By forming accordion type pleat 40 so as to surround the switch, the switch is operable while being completely protected from moisture, chemicals, etc.

In this embodiment and to accommodate pager 10, protective cover 30 is formed with a portion 45 having a thickness of only 0.015 inches. Portion 45 is positioned in overlying relationship to display 13, push buttons 15 and 17, light 19 and speaker 21. While protective cover 30 is formed of a transparent plastic and thinner portion 45 may not be necessary, it was found that the provision of thinner portion 45 enhanced the operation of pager 10 and caused operators to more quickly accept pager 10 with protective cover 30 installed.

While an embodiment of the present invention has been illustrated and disclosed, which substantially covers the top, four sides and at least a portion of the bottom, it will of course be understood that in some instances it may be desirable to cover less of the pager, portable radio, and the like. However, it is believed that as a minimum the protective cover should enclose the major openings (e.g. displays, controls, etc.) and at least partially surround the pager, portable radio, and the like and adhere to the sides to reduce intrusion of moisture, chemicals, etc.

Thus, a new and improved protective cover is described and illustrated which is relatively simple to manufacture and use. Further, the protective cover of the present invention greatly reduces the possibility of water intrusion into devices such as pagers, portable radios, and the like which are used continuously and in many instances under adverse conditions. In addition, the protective cover greatly reduces shock and vibration due to dropping and bumping and, because it can be easily checked by the owner/operator, it will not loose its resilience and resistance to moisture without being detected.

While I have shown and described a specific embodiment of the present invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. A protective cover for a pager comprising a film of transparent, stretchable plastic formed to cover major openings and at least partially surround and adhere to surfaces of said pager, said film being formed to cover the top, four sides and at least a portion of the bottom of said pager and including an opening at the bottom for inserting and removing said pager, said film also including a thicker portion positioned adjacent the bottom edge of said pager when said film is positioned in surrounding adherence to the surfaces of the pager.

2. A protective cover as claimed in claim 1 wherein accordion type pleats are formed in said cover adjacent to switches, belt clips, and the like to allow operation of the switches, belt clips, and the like.

3. A protective cover as claimed in claim 1 wherein the film of transparent, stretchable plastic includes 595HC type high strength silicon plastic.

4. A protective cover as claimed in claim 1 wherein the film of transparent, stretchable plastic is formed by injection molding.

5. A protective cover as claimed in claim 1 wherein the film of transparent, stretchable plastic is formed by compression molding.

6. A protective cover as claimed in claim 1 wherein the film of transparent, stretchable plastic is formed approximately 0.030 inches thick and the thicker portion is formed approximately 0.100 inches thick.

7. A protective cover as claimed in claim 6 wherein the film of transparent, stretchable plastic is formed approximately 0.015 inches thick in areas covering displays, switches, and the like.

8. A protective cover for pagers comprising a film of transparent, stretchable plastic formed to cover the top, four sides and at least a portion of the bottom of said pager and including an opening at the bottom for inserting and removing the pager said film including a thicker portion positioned adjacent to bottom edges of said pager when said film is positioned in surrounding adherence to the surfaces of said pager.

9. A protective cover as claimed in claim 8 wherein the film of transparent, stretchable plastic includes 595HC type high strength silicon plastic.

* * * * *